United States Patent [19]

Hollingsworth

[11] Patent Number: 4,996,968

[45] Date of Patent: Mar. 5, 1991

[54] HANDLE APPARATUS FOR COMPOUND BOW

[76] Inventor: Otis Hollingsworth, 10330 Brookfield Dr., New Orleans, La. 70227

[21] Appl. No.: 407,717

[22] Filed: Sep. 14, 1989

Related U.S. Application Data

[63] Continuation of Ser. No. 74,573, Jul. 17, 1987, abandoned.

[51] Int. Cl.[5] ..... F41B 5/10; 124 23.1; 124 44.5; 124 20.3; 124 20.1; 124 25.6

[52] U.S. Cl. ..... 124/24.1; 124/88; 124/25.6; F41B/5/10

[58] Field of Search ..... 124/25, 24 R, 23 R, 124/86–88, 41A, 20 B, 20 R, 22, 24.1, 23.1, 44.5, 20.3, 20.1, 25.6

[56] References Cited

U.S. PATENT DOCUMENTS

| | | | |
|---|---|---|---|
| 2,125,591 | 8/1938 | Smith | 124/24 R |
| 2,344,799 | 3/1944 | Brown et al. | 124/88 X |
| 2,735,417 | 2/1956 | Denekar | 124/20.1 |
| 3,182,651 | 5/1965 | Huntley | 124/24 R |
| 3,224,427 | 12/1965 | Ronan | 124/25 |
| 3,265,055 | 8/1966 | Gage | 124/24 R |
| 3,537,439 | 11/1970 | Joslin | 124/24 R |
| 3,538,902 | 11/1970 | Fowkes | 124/88 |
| 3,566,853 | 3/1971 | Larm | 124/24 B |
| 3,599,621 | 8/1971 | Scrobell | 124/23.1 |
| 3,834,368 | 9/1974 | Geiger | 124/88 x |
| 4,124,014 | 11/1978 | Darlington | 124/23.1 |
| 4,203,412 | 5/1980 | Rickard | 124/23.1 |
| 4,252,100 | 2/1981 | Rickard | 124/88 X |
| 4,258,689 | 3/1981 | Barnett | 124/25 |
| 4,343,286 | 8/1982 | Thacker | 124/41 A X |
| 4,457,287 | 7/1984 | Babington | 124/23 R |
| 4,587,944 | 5/1986 | Barnett | 124/25 |
| 4,603,676 | 8/1986 | Luoma | 124/25 |
| 4,711,228 | 12/1987 | Gillespie | 124/24 R X |
| 4,756,295 | 7/1988 | Guzzetta | 124/88 X |
| 4,766,874 | 8/1988 | Nishioka | 124/25 |
| 4,787,361 | 11/1988 | Vyprachticky | 124/24.1 X |

*Primary Examiner*—Peter M. Cuomo

*Attorney, Agent, or Firm*—Pravel, Gambrell, Hewitt, Kimball & Krieger

[57] ABSTRACT

An archery bow, of the type having a central riser portion, and a pair of limbs extending therefrom with the bow string connected between the ends of each of the limbs respectively, across the length of the bow, further including an eccentric wheel at each end of the limbs respectively, for creating the mechanical ability to pull and shoot a bow of heavy draw weight without the effort of holding the draw weight. The invention would further comprise an offset, substantially centrally located handle portion secured to a rearwardly extending riser portion, so that the handle is offset in a "V" configuration, so that gripping of the handle along the horizontal plane of the riser allows one to position the bow in the horizontal positions, with the grip below the flight path of the arrow and string.

10 Claims, 2 Drawing Sheets

HANDLE APPARATUS FOR COMPOUND BOW

This is a continuation of co-pending application Ser. No. 07/074,573 filed on July 17, 1987, now abandoned.

BACKGROUND OF THE INVENTION

1. Field of the Invention

The present invention relates to archery. More particularly, the present invention relates to a compound bow providing a centrally situated offset handle for enabling the archer to cast the bow from a horizontal position rather than the vertical.

2. General Background

The bow is one of the oldest of hunting tools known to man, whose development of casting a projectile from a stringed stick occurred in many prehistoric cultures at least 30 millenniums ago, and has changed very little over that time. This instrument of both war and game gathering is depicted in various cave and rock dwellings of Europe, Asia, Africa, and the New World. With the exception of firearms, and gunpowder, the bow and arrow has had the greatest impact on the outcome of the wars and conquest of the great civilizations of Europe and Asia. The bow and arrow as an instrument of war reached its greatest development after the Norman invasions of England in the Battle of Hastings, and figured heavily in England's victory over the French in the Battle of Crecy. The longbow, the principal bow which more than any other displayed the remarkable feats of the English yeoman after the conquest, displaced the much shorter Norman bow. Their superb marksmanship with the longbow is legion, deciding many a battle.

Many British monarchs practiced archery, and were responsible for its promotion and regulation of exacting standards of skill, equipment specification, practice and distribution among its subjects. As a weapon of war, the bow and arrow was replaced by firearms, and became a tool of leisure, managing to intrigue enough followers to carry on its popularity.

The bow and arrow figured significantly in the taming of the American West by explorers and settlers, as it was a formidable weapon in the hands of the American Indians, and again it was gunpowder that eventually prevailed and caused the defeat of the Indians by the settlers and the military in conquest of western lands. With the exception of primitive Indians of South America, and native tribes of Oceania, such as the Solomon Islands, New Hebrides, and New Guinea, whose culture and customs remain relatively unchanged, the bow today is recreational.

The basic bow was a self-bow, or a stave cut from a single piece of wood, which was braced or strung with sinew, and later waxed string. English yew longbows later were backed with skin, and the Asian cultures made use of a shorter composite bow, made from wood, sinew and bone. This strong, compact bow served the Nomadic horseman well under the leadership of Genghis Khan, Attila The Hun, and Alexander the Great, who all conquered on horseback.

American bow development which gained impetus after Saxton Pope and Arthur Young befriended the Yana Indian, Ishi, in 1911 saw first skin-backed yew bows and later lamination of wood, and fiberglass in the recurve bows and longbows. The latest development in bows came during the late 60's with the compound bow, with its use of cables, eccentric wheels and let off, which allowed one to mechanically pull and shoot a bow of a heavy draw weight without the effort of holding the draw weight. This has been the single most improvement in the history of archery, and has opened up a pastime to archers who otherwise may not have taken up archery, as the compound allows one to become an efficient archer in a short period of time, and has reached a new height in technology with state of the art high energy cams, fiberglass limbs, magnesium risers, quick-change modules for adjusting the draw length, multiple draw-weights on the same bow, with take-down possibility for portability. This invention has opened up a whole new industry whose sole purpose is to come up with as many new-fangled accessories to make the compound as pleasant and pleasurable to shoot as an archer could wish.

In all this time however, the bow and arrow has remained unchanged in technique. It still requires an arrow (shaft) nocked on a string, pulled with sufficient force against the bow arm holding the central riser and limbs, until released to the target, only the material and the way that material is used has changed.

The following patents have been issued which may be considered pertinent art:

U.S. Pat. No. 4,124,014 issued to Darlington, entitled "Grip Mount For A Compound Bow", relates to an adjustable bow assembly, for allowing an attachment of a grip that is adjustable for permitting the stated variation of the draw distance. The grip is so attached for allowing it to slide either forward or rearward of the vertical handle. This feature is found in compound archery by the multi-draw wheel, and replaceable modules that permit changing of the draw length from the standard 28" cloth yard to inches below and above that. The invention is attached to a vertical portion of the bow (the riser), and in purpose does not mention horizontal casting capabilities. For it to have these capabilities, it must have a sight window and a riser designed for this express purpose, as a standard vertical riser negates stable arrow flight when turned on its side to be cast cross-wise. Even after the sight window and riser is considered, another crucial problem is the attachment of the handle to the riser area. A grip as shown in the diagram numbered 50 joined 90 degrees or right angles to the main riser section will not allow the string when nocked with an arrow to clear the armpit, preventing correct arrow full draw and release in straight arrow flight, not to mention a tremendous slapping of the biceps and upper forearm with the string when released.

U.S Pat. No. 4,603,676 issued to Louma, entitled "Bow Drawback Mechanism", is a mechanism which can be used only with the crossbow. This device as invented can only be used with a crossbow, as stated in item 20 of the summary of the invention "to provide a cocking mechanism adapted for crossbows". This said device serves the same purpose as the standard crossbow gun stock, it simply replaced the fore-end and butt-section with a forward (vertical) grip and a rearward grip trigger mechanism, joined by a connecting rod 14 that holds the fore 28 and aft 40 grips in a stationary position. All of which allows cocking of the bolt along the connecting rod, held at the aft grip 40, storing of the energy in the limbs along this connecting rod 14, until the the trigger mechanism 42 is disengaged at the rearward grip thus releasing this energy. The crossbow is described in the description of the prior art, and has its own manner of cocking and shooting procedures, and in no way shares any procedural art with conventional longbow, recurve, and compound archery.

U.S. Pat. No. 2,344,799 issued to Brown, entitled "Archery Bow", relates to a bow having an offset handle portion that allows the arrow to be cast through the center of the handle, (plane of the bow) or where the handle normally would be. It claims improved bow construction, enabling greater shooting accuracy and increased shooting power with the application of the same or less force needed in shooting a bow under normal circumstances. This claim from 1941 is no longer valid, as the compound bow that came into development in the late 60's, laid all these assertions to rest. Anyone familiar with modern archery is aware of the current ease, power, and accuracy of the compound bow with its cables, eccentrics, multi-draw length modules, and 50 percent let off, making the compound the most powerful, accurate, and efficient bow in use today.

The features of the "Archery Bow" were intended for a vertical bow, and does not address horizontal casting, as from the drawings it would have been impossible to perform, as there would be no sight window or arrow rest provided for horizontal casting of an arrow, not to mention the impossibility of clearing the armpits with the string attached to limbs with an offset handle left in its present position, along the riser path, since most of the riser section is cut away.

The remainder of the patents, i.e., U.S. Pat. Nos. 4,343,286; 4,457,287; and 4,203,412 were included in the search since they teach handles for compound bows that allow the archer to grip the bow off center.

SUMMARY OF THE PRESENT INVENTION

The apparatus of the present invention solve the shortcomings in the art in a simply and straightforward manner. What is provided is an archery bow, of the type having a central riser portion, and a pair of limbs extending therefrom with the bow string connected between the ends of each of the limbs respectively, across the length of the bow, further including a concentric wheel at each end of the limbs respectively, for creating the mechanical ability to pull and shoot a bow of heavy draw weight without the effort of holding the draw weight. The invention would further comprise an offset, substantially centrally located handle portion secured to a rearwardly extending riser portion, the handle being offset in a "V" configuration, so that gripping of the handle along the horizontal plane of the riser allows one to position the bow in the horizontal position, with the grip below the flight path of the arrow and string. The latter most portion of the rearwardly extending riser would serve to rest upon the upper portion of the archer's wrist to ensure stability of bow during draw of the string. There is further provided a notched portion on the top of the riser for setting the arrow therewithin during the drawing of the bow.

Therefore, it is a principal object of the present invention to provide an archery bow that can draw and release an arrow while the bow is in the horizontal position;

It is still a further principal object of the present invention to provide a compound bow wherein the handle grip is positioned at a point below the principal riser body, and parallel thereto for allowing horizontal positioning of the bow during drawing action;

It is still a further object of the present invention to provide an improved handle for a compound bow which is offset from the main riser, and at a proper angle alignment that would allow for leverage on some part of the forearm holding the handle to permit level and stable forward flight of the arrow when released;

It is still a principal object of the present invention to provide an offset handle for a compound bow which is situated below the principal riser portion, so that the string clears the arm pit of the bow arm when pulled full anchor at the corner of the chin;

It is still a principal object of the present invention to provide an offset handle with the compound bow which allows the bow hand to be kept away from the riser when the bow is fired while parallel to the ground for preventing string slapping to the biceps and forearm of the bow hand; and It is still a further object of the present invention to provide a modified bow handle having an outward "V" angle of the riser causing a downward tug against the bow when pulled at the nocked arrow from the center of the string, so that when the arrow is released at this point of the nock in a slightly back and upward direction, the result is straight level forward flight of the arrow.

BRIEF DESCRIPTION OF THE DRAWINGS

For a further understanding of the nature and objects of the present invention, reference should be had to the following detailed description, taken in conjunction with the accompanying drawings, in which like parts are given like reference numerals, and wherein.

DETAILED DESCRIPTION OF THE PREFERRED EMBODIMENT

Figure 1:
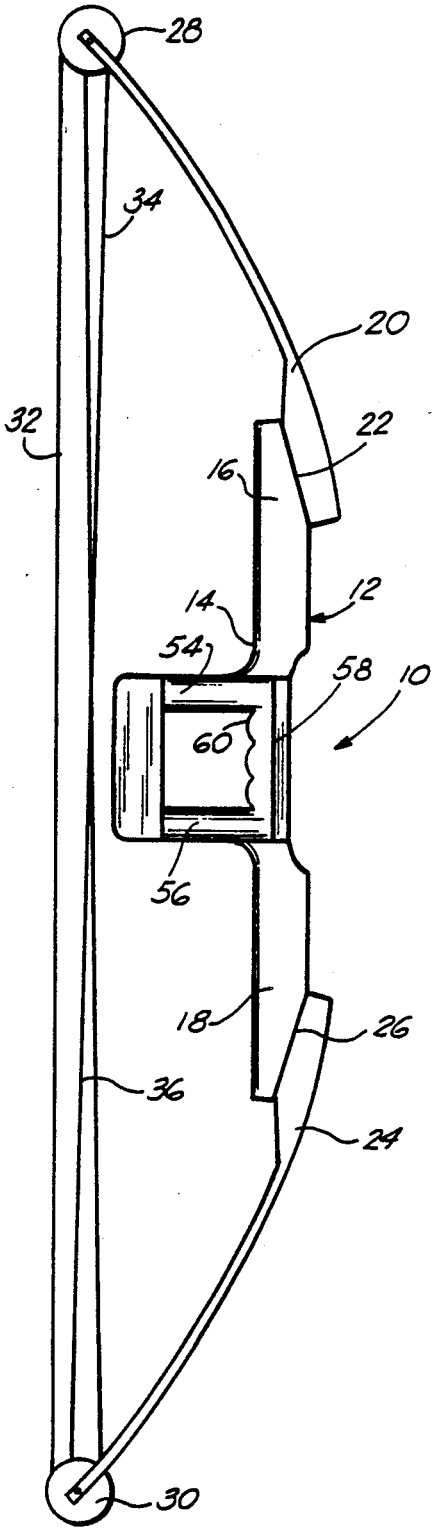
FIG. 1 is an underside view of the preferred embodiment of the apparatus of the present invention.
Figure 2:
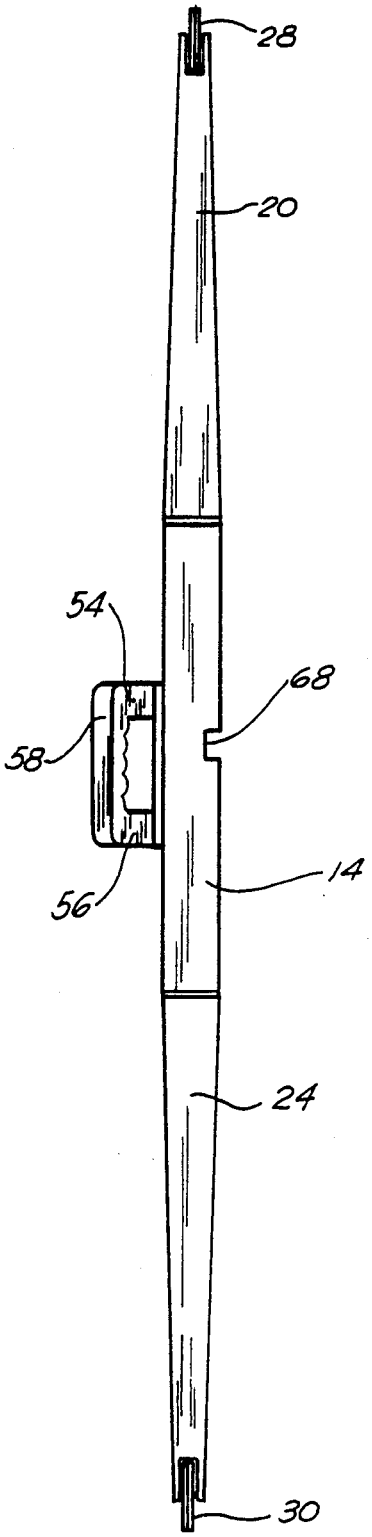
FIG. 2 is a front view of the preferred embodiment of the apparatus of the present invention.

As is illustrated in FIGS. 1–4, the apparatus of the present invention is illustrated by the numeral 10. What is provided, is a compound bow 12 comprising a central riser section 14, the riser section being for the most part a typical riser having a first riser arm 16, a second riser arm 18, with the riser arm 16 to accommodate a first bow limb 20 rigidly secured at face 22 to riser arm 16 and an identical bow limb 24 likewise rigidly secured at face 26 to riser arm 18, the riser 14 together with limbs 20 and 24 configuring the compound bow 12 of the present invention. As seen in the Figure, as with a typical compound bow as presently constructed, compound bow 12 would be of the type which would allow one to mechanically pull and shoot bow 12 which would be of heavy draw weight without the effort of holding that draw weight prior to the release of the arrow. This feature, commonly seen in compound bows includes a pair of concentric wheels 28 and 30 offset and rotatably mounted at each end of bow limbs 20 and 24 respectively, with a continuous cable 32 extending therebetween so that the pair of the cable lengths 34 and 36 provide the pulley type effect as principal cable line 32 to which an arrow would be set thereupon, would be the principal draw line of the bow. Again, this type of configuration wherein an independent riser section 14 has a pair of limbs 20 and 24 mounted on either end is very common in the industry and therefore is illustrated as such.

Figure 4:
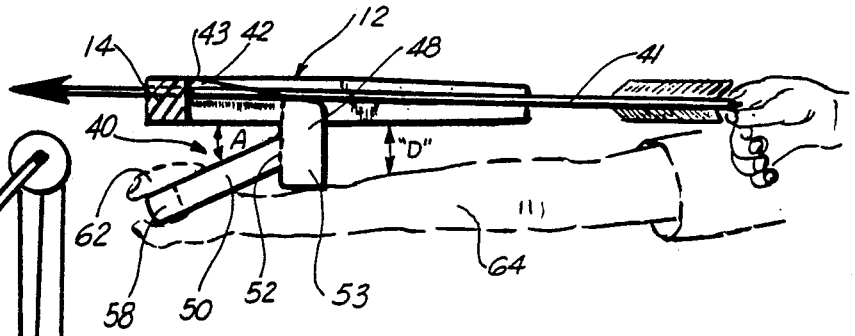
FIG. 4 is a cross-sectional view of the apparatus of the present invention through the central riser section.
Figure 3:
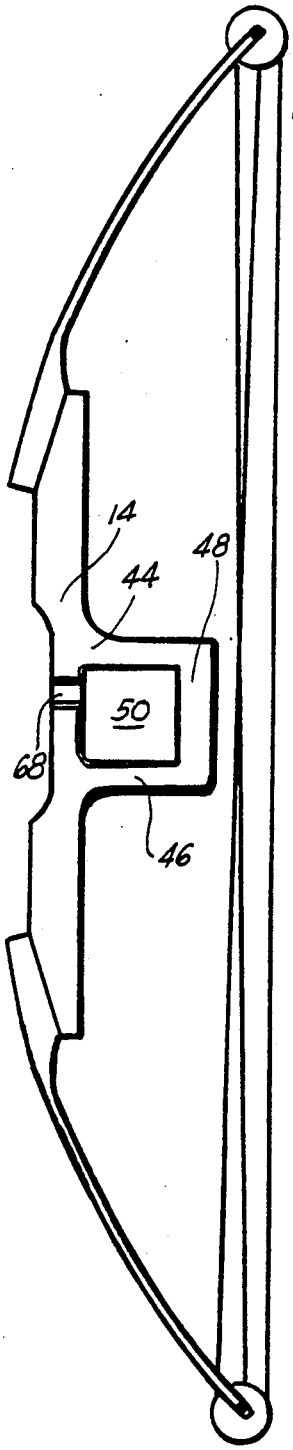
FIG. 3 is a top view of the preferred embodiment of the apparatus of the present invention.

As was stated earlier, it is principal feature of the present invention to provide a compound bow such as bow 12, which can be shot holding the bow comfortably in the horizontal position as seen in FIG. 4. This is accomplished by a novel means 40 for holding the bow in the horizontal position during drawback of arrow 41 as seen in the Figure. This holding means 40 as seen in the Figures would comprise a secondary riser section 42 extending rearward from the inner face 43 of principal riser 14 substantially located at the center of riser 14 as seen particularly in FIG. 1. Rearwardly extending secondary riser portion 42 would actually comprise a pair of rearwardly extending riser arms 44 and 46 integrally mounted to riser 14 as seen in FIG. 3. The pair of arms 44 and 46 would be in spaced relation having a rear portion 48 interconnecting the two, to provide a central opening 50 within this configuration. Rearward interconnection section 48 as seen in FIG. 4 would provide a means for mounting a principal handle 50 which is crucial to the present invention. Handle 50 would be rigidly attached at point 52 to the lower portion 53 of rear connector section 48 at an angle A downwardly depending therefrom, said angle A being of an angle between 60° and 70° of the vertical. As seen in FIG. 1, handle 50 would also constitute a pair of arms 54 and 56 projecting forwardly from the lower rear section 53 of section 48, with an interconnecting gripper portion 58 extending therebetween, having a series of grips 60 whereby ones hand could be wrapped around gripper portion 58 as seen in FIG. 4. As seen in the Figure, by grasping ones hand with the fingers 62 above the top face of cross-section 58, ones arm 64 is substantially a distance D below Arrow 41 and likewise cable 32, and therefore clears any path of the cable as the arrow is released. In addition, the positioning of the cross-section 58 of handle 40, enables the archer to support the bow in the horizontal position, with rear portion 53 of riser 48 resting on arm 64 as seen in the Figure and therefore maintaining the bow in balance while holding it in the horizontal position.

Likewise as seen in FIG. 3, main riser 14 would also include a travel space 68 wherein Arrow 41 would rest thereupon during drawback of the arrow, to allow proper flight of the arrow from bow 12. In terms of construction, the present invention would be a one-piece laminated wood, or a one-piece cast magnesium riser, with the offset handle grip 58 that would create level arrow flight when joined to standard bow limbs 20 and 24.

The configuration of this novel riser and handle is designed to be nocked with an arrow on the string, and the nocked arrow held in hand drawn to chin with the right hand for a right handed archer, and the other arm outstretched horizontal and forward with the hand gripping the handle in the horizontal manner, while the limbs and riser are to remain in the horizontal position during the entire nocking, drawing, anchor and release of the arrow. The invention constitutes a one-piece riser and handle shape to accommodate joining to bow limbs, having the sight window formed in the upright riser section to the right of the riser's geographic center; and a handle fashioned at a distance far enough below the upright plane of the riser to allow for stable and unhindered draw and release of an arrow in true flight, with no string slap to the biceps or forearm. When viewed from the tip of the limbs at side view, this grip shaped like an open ended rectangle is positioned in two angles to the main riser sections vertical axis, 90° at the top angle and 70° at the hand grip. When viewed from the tip of the limbs at side view, this attachment of the handle resembles a "V" turned on its side. This handle rests on the wrist of the bow arm giving leverage to the riser section when pulling against the string arm at the point where the arrow is nocked.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A riser and handle combination, for a long bow, comprising:

(a) a riser means having a top and a bottom and a longitudinal axis;

(b) a gripper means having a longitudinal axis;

(c) a travel space means for receiving an arrow when the longitudinal axis of the riser means is horizontal;

(d) means for attaching the riser means to limbs of a long bow; and (e) connection means comprising a pair of generally V-shaped members, each member having an apex, a first end, and a second end, the first ends of the substantially V-shaped members being connected to the riser means, the second ends of the substantially V-shaped members being connected to the gripper means, and the apexes of the substantially V-shaped members being connected to an arm-support means, wherein when the longitudinal axis of the riser means is oriented horizontally:

(i) the travel space means is on the top of the riser means and opens upwardly; and (ii) the longitudinal axis of the gripper means is spaced below the bottom of the riser means.

2. The combination of claim 1, wherein:

each substantially V-shaped member comprises two arms, and the angle between the two arms is between 60° and 70°.

3. The combination of claim 1, wherein:

each substantially V-shaped member comprises two arms, and the angle between the two arms is approximately 70°.

4. The combination of claim 1, wherein:

the arm-support means has a longitudinal axis, and the longitudinal axes of the riser means, the gripper means and the arm-support means are parallel to one another.

5. The combination of claim 1, wherein when the longitudinal axis of the riser means is oriented horizontally:

the longitudinal axis of the gripper means is substantially vertically aligned with the longitudinal axis of the riser means.

6. A compound bow comprising:

(a) a centrally located riser means having a top and a bottom and a longitudinal axis;

(b) a gripper means having a longitudinal axis;

(c) a travel space means for receiving an arrow when the longitudinal axis of the riser means is horizontal;

(d) first and second limb portions extending from the riser means, the limb portions each having a first end;

(e) a cable means interconnecting the first ends of the limb portions rearward of the riser means; and (f) connection means comprising a pair of generally V-shaped members, each member having an apex, a first end, and a second end, the first ends of the substantially V-shaped members being connected to the riser means, the second ends of the substantially V-shaped members being connected to the gripper means, and the apexes of the substantially V-shaped members being connected to an arm-support means, wherein when the bow is oriented horizontally:

(i) the travel space means is on the top of the riser means and opens upwardly; and (ii) the longitudinal axis of the gripper means is spaced below the bottom of the riser means.

7. The bow of claim 6, wherein:

each substantially V-shaped member comprises two arms, and the angle between the two arms is between 60° and 70°.

8. The bow of claim 6, wherein:

each substantially V-shaped member comprises two arms, and the angle between the two arms is approximately 70°.

9. The bow of claim 6, wherein:

the arm support means has a longitudinal axis, and the longitudinal axes of the riser means, the gripper means and the arm support means are parallel to one another.

10. The bow of claim 6, wherein when the bow is oriented horizontally:

the longitudinal axis of the gripper means is substantially vertically aligned with the longitudinal axis of the riser means.

* * * * *